US009168445B2

(12) United States Patent
Jones et al.

(10) Patent No.: US 9,168,445 B2
(45) Date of Patent: Oct. 27, 2015

(54) ADJUSTABLE GOLF TRAINING AND TEACHING DEVICE FOR HEAD AND CHIN ADJUSTMENT WITH STEREO VIEW OF GOLF BALL

(71) Applicants: Michael D. Jones, Orlando, FL (US); Teresa R. Jones, Orlando, FL (US)

(72) Inventors: Michael D. Jones, Orlando, FL (US); Teresa R. Jones, Orlando, FL (US)

( * ) Notice: Subject to any disclaimer, the term of this patent is extended or adjusted under 35 U.S.C. 154(b) by 0 days.

(21) Appl. No.: 14/222,671

(22) Filed: Mar. 23, 2014

(65) Prior Publication Data

US 2015/0151181 A1 Jun. 4, 2015

Related U.S. Application Data

(60) Provisional application No. 61/808,611, filed on Apr. 4, 2013.

(51) Int. Cl.
*A63B 69/36* (2006.01)

(52) U.S. Cl.
CPC ..... *A63B 69/3608* (2013.01); *A63B 2069/3629* (2013.01); *A63B 2209/00* (2013.01); *A63B 2209/02* (2013.01)

(58) Field of Classification Search
USPC ..... 473/208, 209, 210, 211, 257, 268
See application file for complete search history.

(56) References Cited

U.S. PATENT DOCUMENTS

| | | | | | |
|---|---|---|---|---|---|
| 2,663,021 | A * | 12/1953 | Douglass | 2/433 |
| 2,669,782 | A * | 2/1954 | Turner | 473/268 |
| 3,826,502 | A * | 7/1974 | Sorge | 473/210 |
| 4,531,743 | A * | 7/1985 | Lott | 473/210 |
| 4,762,325 | A * | 8/1988 | McCleery | 473/210 |
| 4,852,882 | A * | 8/1989 | Otsuka et al. | 473/210 |
| 4,969,649 | A * | 11/1990 | Lugiewicz | 473/210 |
| 5,171,152 | A * | 12/1992 | McCleery | 473/210 |
| 5,538,250 | A * | 7/1996 | Putz | 473/210 |
| 6,390,823 | B1 * | 5/2002 | Wesenhagen | 434/252 |

* cited by examiner

*Primary Examiner* — Nini Legesse
(74) *Attorney, Agent, or Firm* — Allen, Dyer, Doppelt, Milbrath & Gilchrist, P.A.

(57) ABSTRACT

A golf training and teaching device is provided for a golfer wearing a hat having a brim. The device includes a right-side L-shaped member and a left-side L-shaped member. The right-side L-shaped member includes an upper leg and a lower leg depending from the upper leg, with the lower leg having a sighting opening therein configured to be positioned adjacent the right eye of the golfer. The left-side L-shaped member includes an upper leg and a lower leg depending from the upper leg, with the lower leg having a sighting opening therein configured to be positioned adjacent the left eye of the golfer. The right-side and left-side L-shaped members are slidably coupled in partially overlapping relation so that the respective upper legs thereof overlay and define a clamp to be secured onto the brim of the hat. The sighting openings are configured to provide a visual containment area for a golf ball positioned adjacent the golfer's feet.

9 Claims, 9 Drawing Sheets

ADJUSTABLE GOLF TRAINING AND TEACHING DEVICE FOR HEAD AND CHIN ADJUSTMENT WITH STEREO VIEW OF GOLF BALL

FIELD OF THE INVENTION

The present invention is in the technical field of golf. More particularly, the present invention is in the technical field of portable golf training and teaching devices. More particularly, the present invention pertains to the area of adjusting set up or addressing position and a means to observe movement during the golf swing.

BACKGROUND OF THE INVENTION

Since the beginning of golf, players and instructors have tried to build more repeatable and effective golf swings. Many areas of golf have improved enormously through the years. Equipment including drivers, irons, wedges, putters, balls, gloves, shoes, greens, golf courses, teaching techniques, and instructors have all evolved. Computers have launched golf into a new era. Now we can calculate launch angle, ball speed, spine angle, body position, body rotation, club path, impact position and much more.

Two areas of golf remain a challenge for instructors and players alike. Number one is the ability to master the set up position. In many ways the set up position mirrors the impact position. This is so important for the player to have the ability to swing the club repetitiously and be able to generate as much club head speed as possible. Correct spine angle at address gives the player the ability to rotate on the back swing while staying on a fixed axis. It is necessary to correctly position the chin to allow the shoulders to rotate without interference, and to aid the player in setting head and eyes level in the address position. This is important so the body is in the correct position for the down swing.

Number two brings us to the next unarguable fundamental in golf—keeping your head steady and your eyes focused on the ball. For centuries teachers have held a player's head stable or placed a club or object on the head to keep it stable. Many devices over the years have been tried to help teachers and players accomplish this. Most devices are large and bulky, some are very expensive, and others only allow a player to use the device indoors or in a fixed area. Many of these devices are not functional or effective.

As most great teachers in golf know muscle memory can be either positive or negative. Training aids that help players create the positive muscle memory are rare. A training aid that a player can train and practice in is obviously rarer. The most inconceivable is the training aid that can be used to train, practice and play in to build the elusive positive muscle memory while actually hitting a golf ball. Accordingly, there is a need to help golfers master these two areas, and to help every golfer with every shot from putting, chipping, iron shots, drives, and so on. There is a further need to do all of this while aiding the player with the two most unarguable fundamentals in golf: a means to address the ball in the proper position for repeatability and power while allowing the player to hit hundreds of golf balls from the same set up, or address position to develop this positive muscle memory before having to take the device off.

SUMMARY OF THE INVENTION

In view of the foregoing, an object of the invention is to provide a device that aids the player to keep his or her head stable while keeping their eyes focused on the ball for instant feedback of movement. Such a device eliminates a video camera or having someone hold the players head steady as teachers have done for centuries.

A golf training and teaching device is provided for a golfer wearing a hat having a brim. The golf training and teaching device advantageously gives the player instant feedback on movement during his or her swing. Also, the golf training and teaching device advantageously gives the player a means to adjust the start up or address position to enable the player to be in a position of power and consistency in the back swing.

More particularly, the golf training and teaching device is provided for a golfer wearing a hat having a brim, and comprises a right-side L-shaped member and a left-side L-shaped member. The right-side L-shaped member may comprise an upper leg and a lower leg depending from the upper leg, with the lower leg having a sighting opening therein configured to be positioned adjacent the right eye of the golfer. The left-side L-shaped member may comprise an upper leg and a lower leg depending from the upper leg, with the lower leg having a sighting opening therein configured to be positioned adjacent the left eye of the golfer. The right-side and left-side L-shaped members may be slidably coupled in partially overlapping relation so that the respective upper legs thereof overlay and define a clamp to be secured onto the brim of the hat. The sighting openings of the right-side and left-side L-shaped members may be configured to provide a visual containment area for a golf ball positioned adjacent the golfer's feet.

The lower legs of the right-side and left-side L-shaped members may diverge outwardly from one another. The lower legs of the right-side and left-side L-shaped members may each have slotted adjustment openings therein. A fastener may be positioned through the slotted adjustment openings. In one embodiment, the fastener may comprise a screw and a nut.

The lower leg of the right-side L-shaped member may be longer than the leg of the left-side L-shaped member to define a gap between the upper legs. The sighting openings may each have a circular shape. The circular shaped sighting openings may have a diameter in a range of 1 to 75 mm. Alternatively, the sighting openings may each have a rectangular shape. The right-side and left-side L-shaped members may each comprise a transparent material.

BRIEF DESCRIPTION OF THE DRAWINGS

FIG. 2*b* shows how rectangular sighting holes also create one large rectangular stereo containment area 14 around the ball 15.

DETAILED DESCRIPTION OF THE PRESENT INVENTION

Figure 1:
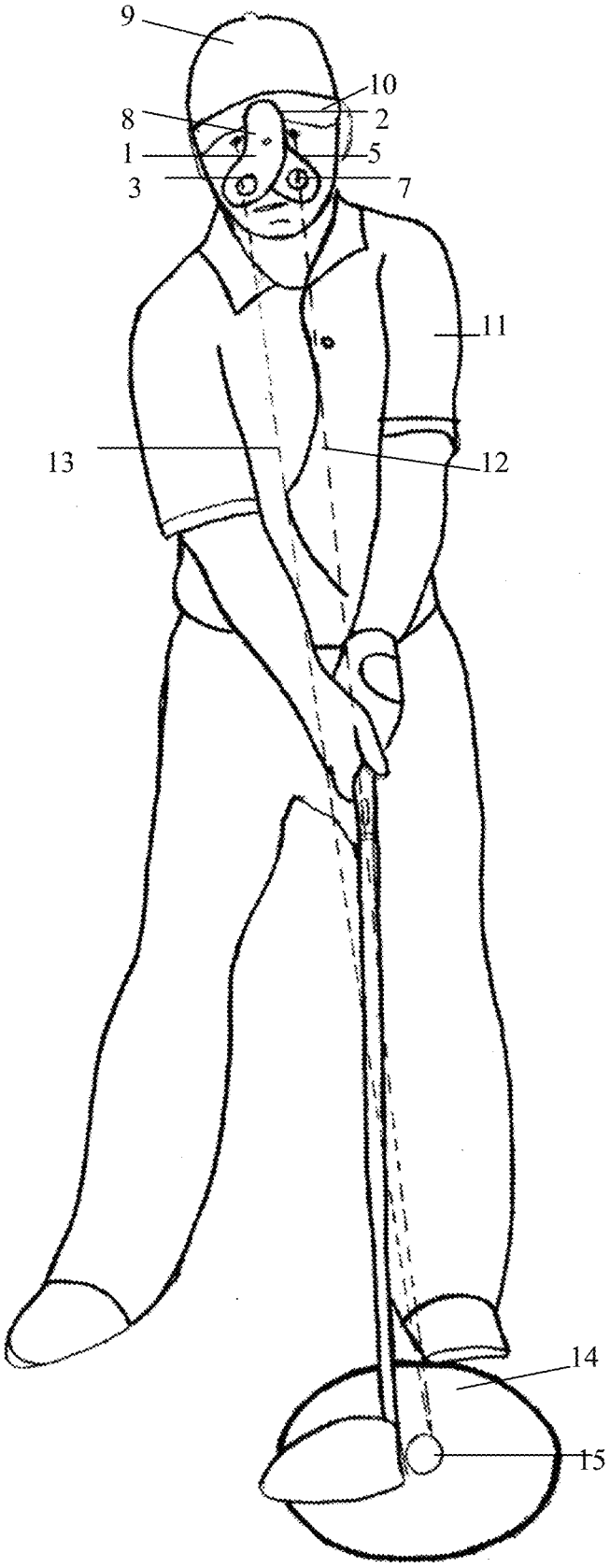
FIG. 1 is a perspective view of the golf training and teaching device as it is used by a golfer, showing stereo view of a containment area while in an address or set-up position.

FIG. 1 is a perspective view of a portable golf training and teaching device depicted being used by a golfer to generate a stereo view 12 and 13 of the containment area 14. This stereo view 12 and 13 of the containment area 14 with the golf ball 15 as generated by proper adjustment of the portable golf training and teaching device. Furthermore, the containment area 14 is created when sighting holes 3 and 7 are set properly to produce sighting lines 12 and 13 which create the stereo view of the containment area 14. The object of the portable golf training and teaching device is to keep the ball 15 in the center of the containment area 14 during the golf swing. This helps the player accomplish a single axis rotation for a more repeatable golf swing.

Figure 2A:
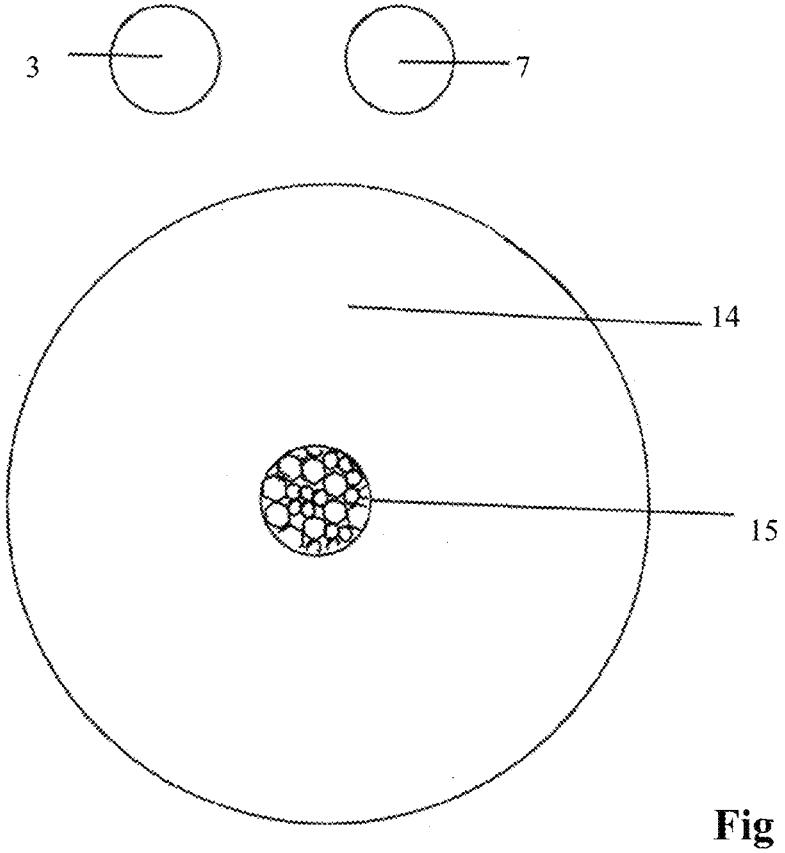
FIGS. 2*a* and 2*b* show an enlarged view demonstrating how viewing through sighting holes of the same shape will create one large stereo containment area around the ball in that shape. Shown in FIG. 2*a* are circular sighting holes that create one large circular stereo containment area around the ball.
Figure 2B:
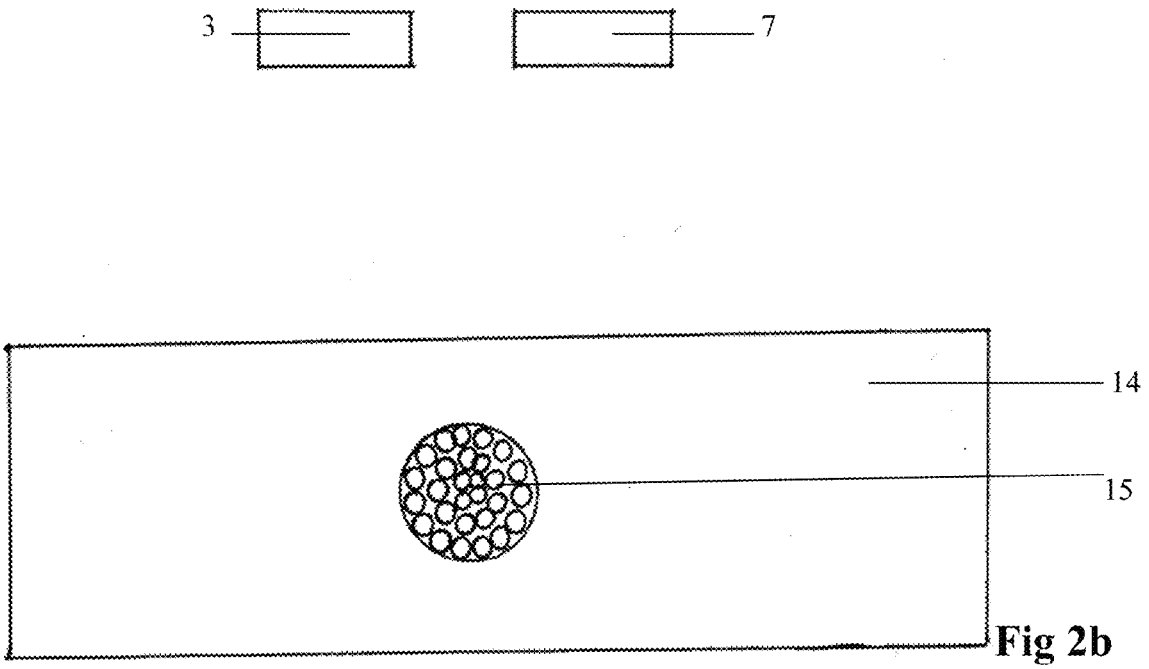

FIG. 2*a* and FIG. 2*b* demonstrate how viewing through sighting holes 3 and 7 of the same shape will create one large stereo containment area 14 around the ball 15 in that shape. Shown in FIG. 2*a* are circular sighting holes 3 and 7 that create one large circular stereo containment area 14 around the ball 15. FIG. 2*b* has rectangular sighting holes 3 and 7 that create 1 large rectangular stereo containment area 14 around the ball 15.

Figure 3:
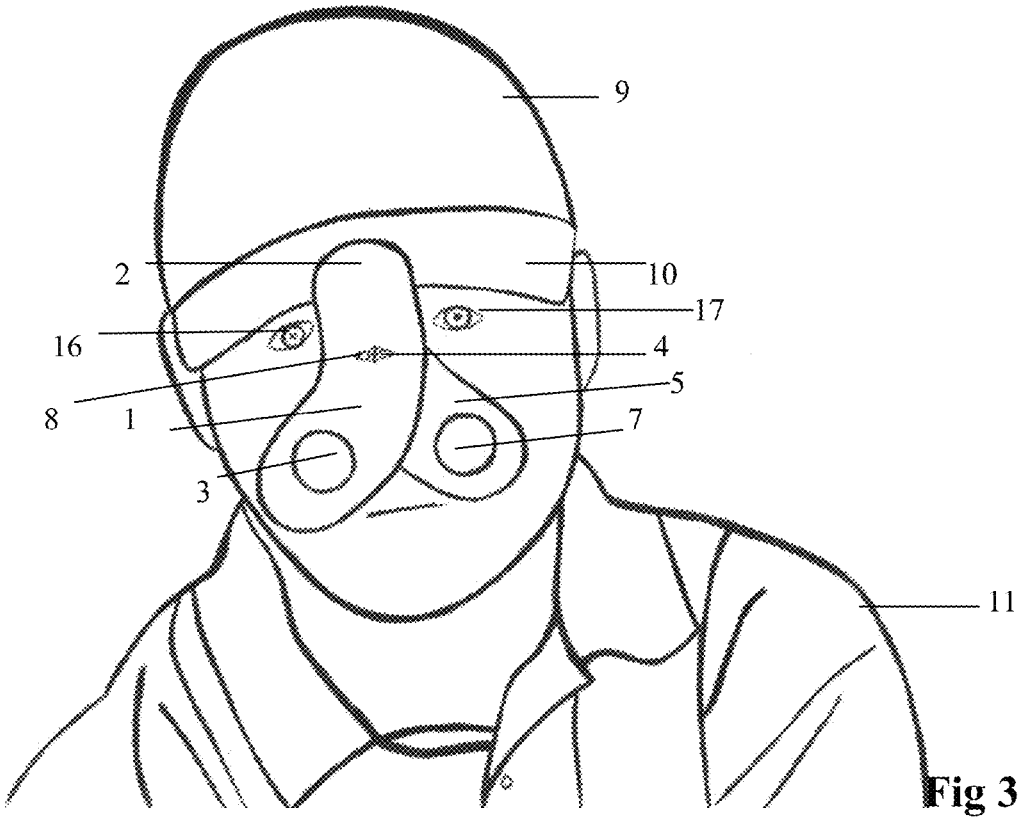
FIG. 3 is an enlarged perspective view of the golf training and teaching device attached to the brim of the golfer's hat with the golfer looking past the clip to view the ball in flight after being struck and showing how a player views intended target.

FIG. 3 shows a perspective view of the portable golf training and teaching device mounted on the golfer's hat 9, and more specifically, to the hat's brim 10. The right side component 1 and the left side component 5 of the portable golf training and teaching device show sighting holes 3 and 7 that can be adjusted by sliding the right side component 1 and the left side component 5 using an adjustment slide 8 to accommodate all pupillary distances. Adjustment of the sighting holes 3 and 7 create the stereo containment area 14 around the golf ball 15. This gives the player a three dimensional stereo view of the containment area 14 around the golf ball 15. This provides the golfer with instant feedback of any movement during the golf swing.

Figure 4:
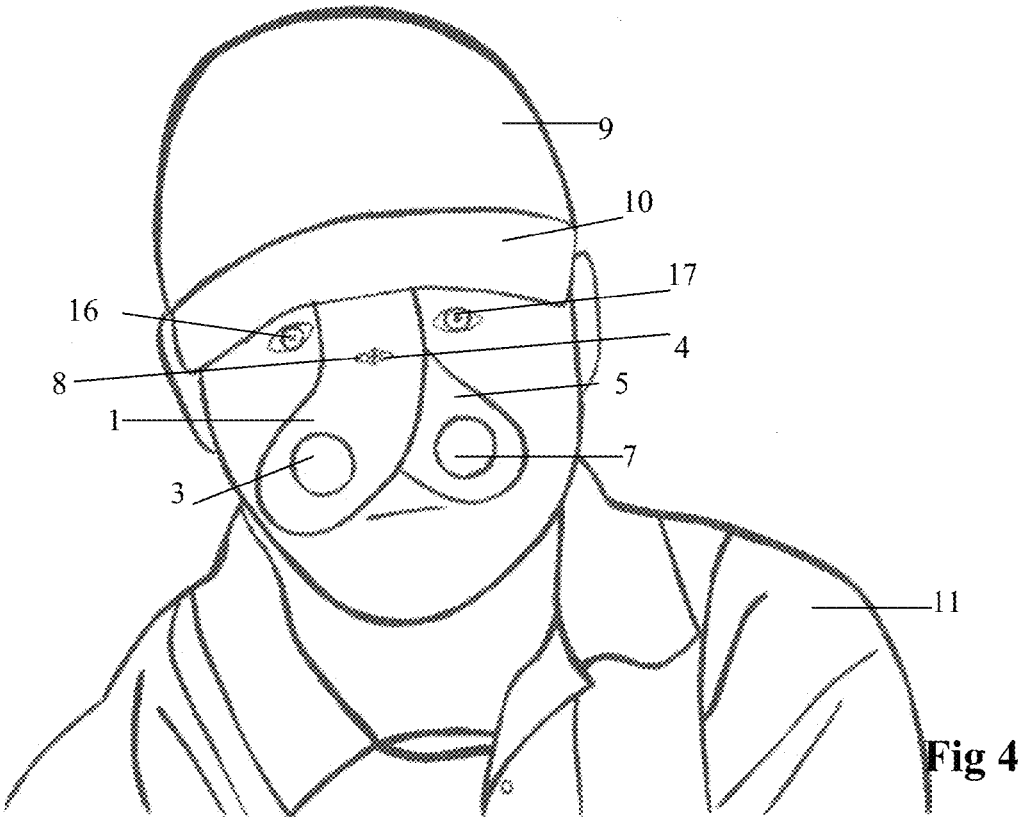
FIG. 4 is an enlarged perspective view of the golf training and teaching device molded into to the brim of the golfer's hat with the golfer looking past the clip to view the ball in flight after being struck and showing how a player views the intended target.

FIG. 4 shows a perspective view of the golfer looking 16 and 17 past the portable golf training and teaching device to view the target and the ability to follow the ball in flight after being struck with an unrestricted view. FIG. 4 also shows a perspective view of the portable golf training and teaching device molded into the brim of the hat.

Figure 5:
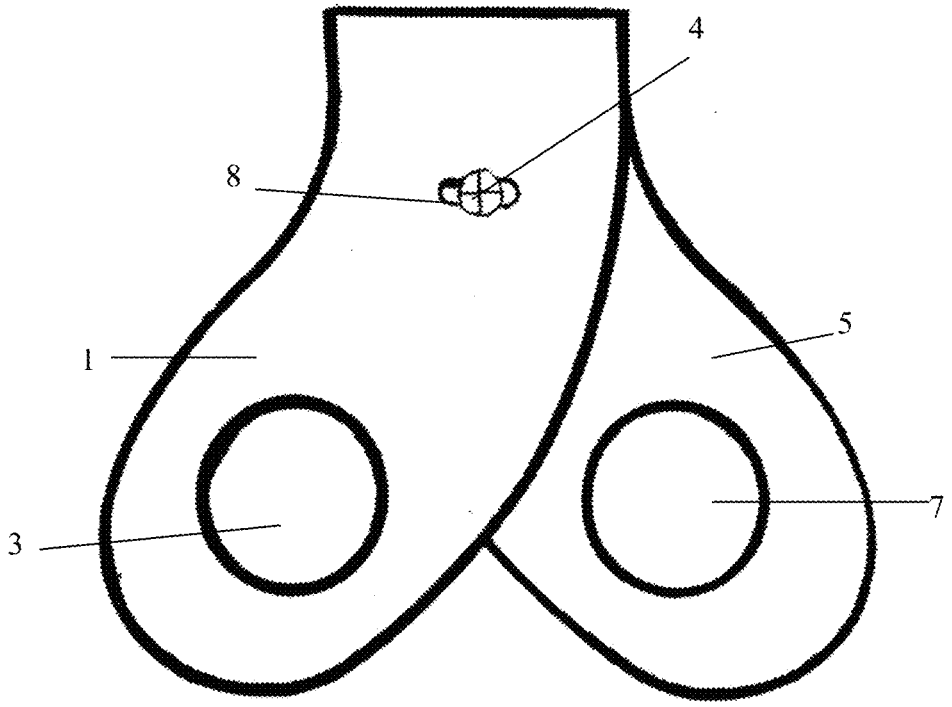
FIG. 5 is a front view of the golf training and teaching device showing the adjustment slider hole and the set screw.

FIG. 5 shows a close up view of the portable golf training and teaching device showing the adjustable slide hole 8 and the set screw 4. Also depicted is a sighting hole 3 on the right side of the component 1 and a sighting hole 7 on the left side of the component 5.

Figure 6:
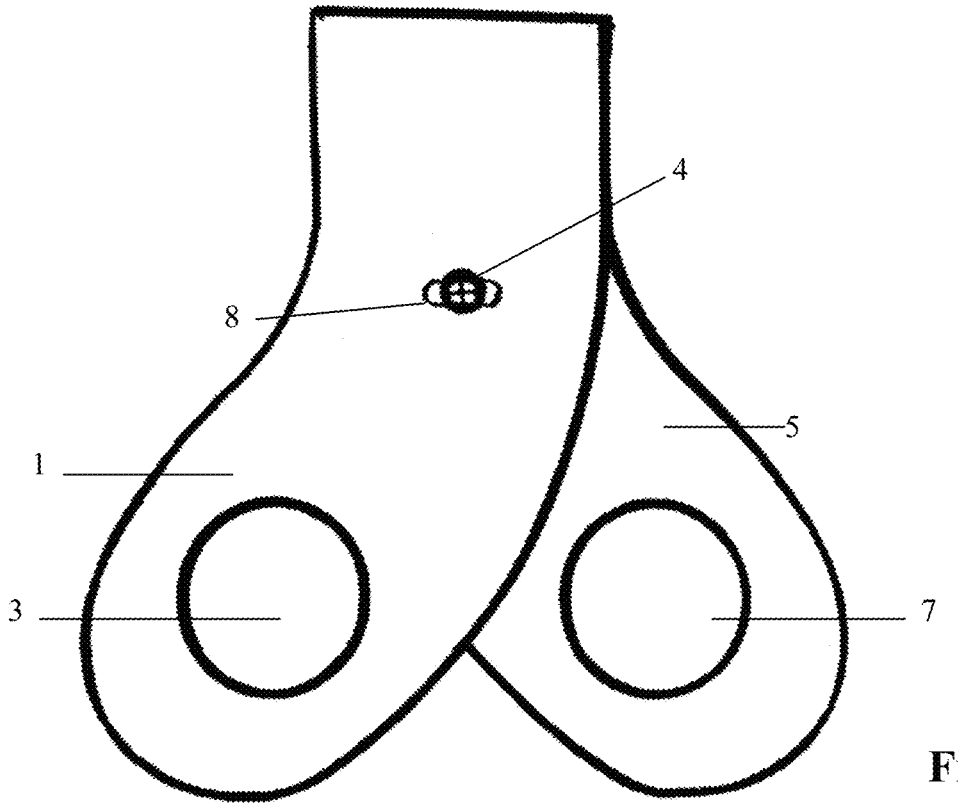
FIG. 6 is a front view of the golf training and teaching device showing a longer left and right component to increase adjustability of chin and head position for more vertical adjustment up or down.

FIG. 6 shows a close up view of the portable golf training and teaching device showing the adjustable slide hole 8 and the set screw 4. Also depicted is the sighting hole 3 on the right side of the component 1 and the sighting hole 7 on the left side of the component 5. Also depicted is a longer right side component 1 and a longer left side component 5 to increase adjustability of the chin and head vertically.

Figure 7:
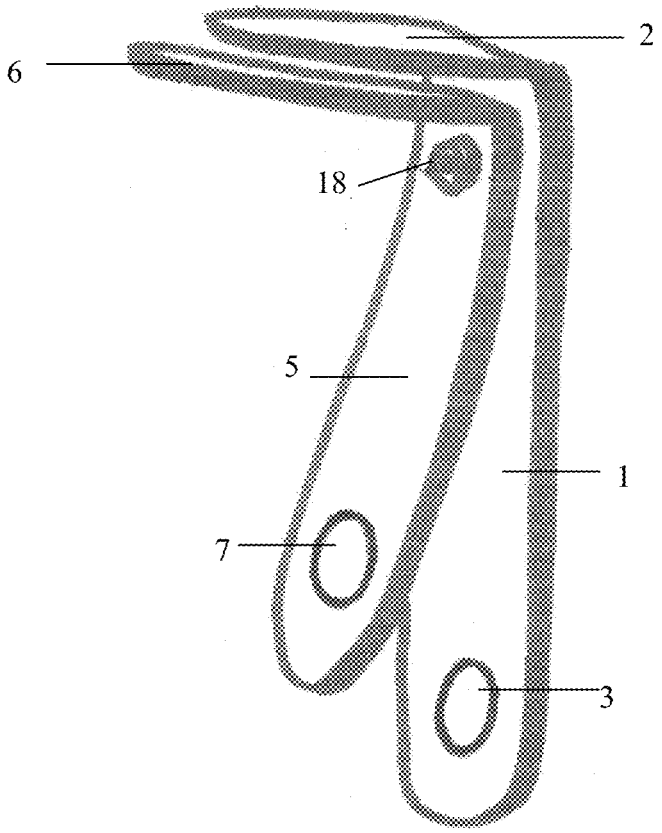
FIG. 7 is a close up view of the golf training and teaching device from the right side showing the right and left components forming the clip.

FIG. 7 shows a close up view of the portable golf training and teaching device from the right side. Depicted is the bottom clip 6 that is formed from the left side component 5. Also shown is the top clip 2 formed from the right side component 1. The locking nut 18 attaches to the set screw 4 (see FIG. 8) to secure components 1 and 5 together. The adjustment slide is not shown here but is shown in FIG. 8.

Figure 8:
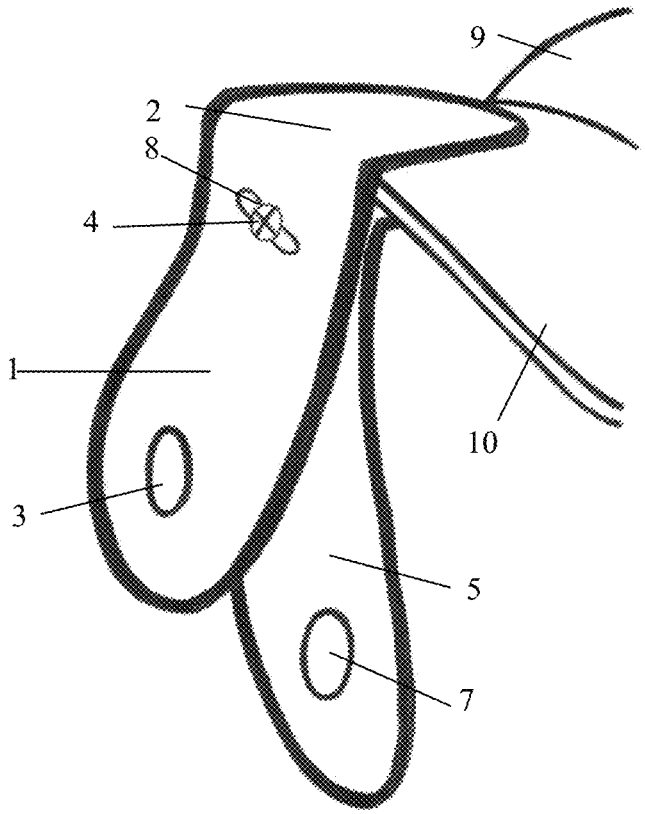
FIG. 8 is an enlarged side view of the golf training and teaching device with the clip mounted in the center of the brim of the hat.

FIG. 8 shows a perspective view of the portable golf training and teaching device attached to the brim of a hat 10 between clips 2 and 6. The portable golf training and teaching device is attached to the center portion of the brim of the hat 10. Also shown in FIG. 8 are the sighting holes 3 and 7, set screw 4 and adjustment slide hole 8.

Figure 9:
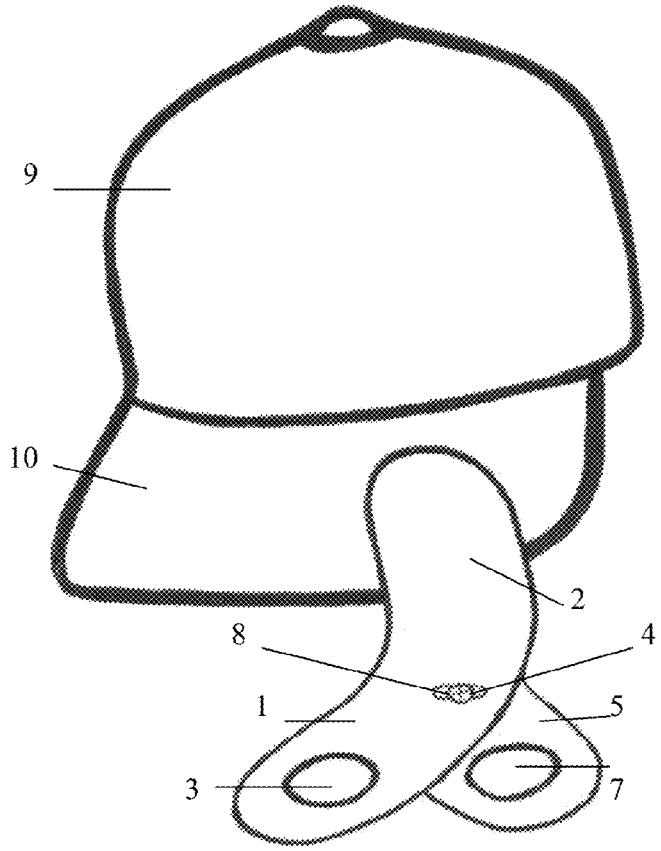
FIG. 9 is a perspective front view of the golf training and teaching device moved forward on the brim of the hat, toward the target, for a right or left handed golfer to encourage or enable a player to rotate their head away from the target for a larger unrestricted shoulder turn.

FIG. 9 shows a perspective view of the portable golf training and teaching device showing clips 2 and 6 (6 not shown-under brim of hat) have been moved to the left side of the brim of the hat 10 to create a maximum shoulder turn in the backswing for a right handed golfer. This adjustment of the portable golf training and teaching device directs the player to turn his or her head away or swivel it away from the target to the right to maximize shoulder rotation. When the device is moved the sighting holes 3 and 7 must be realigned to recreate stereo vision. The clip 2 and 6 (6 not shown) can be moved to the right side of the brim of the hat 10 for a left handed golfer.

Figure 10:
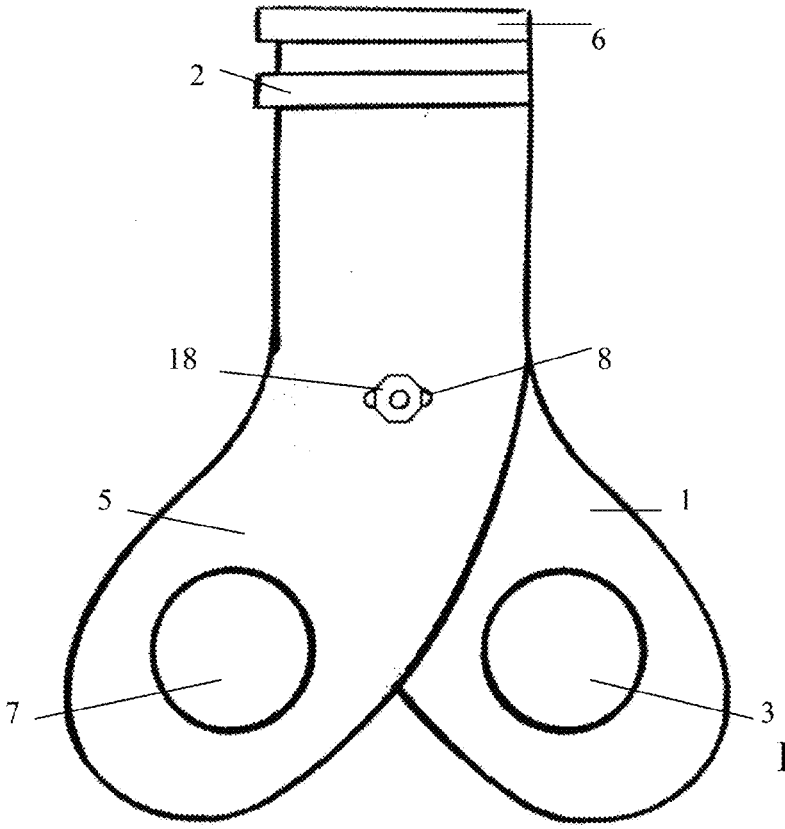
FIG. 10 is a back view of the golf training and teaching device showing how the left and the right components create the clip at the top thereof.

FIG. 10 shows the portable golf training and teaching device from the back with the clips 2 and 6 at the top and the slider hole 8 and nut 18. Also shown are sighting holes 3 and 7.

Figure 11:
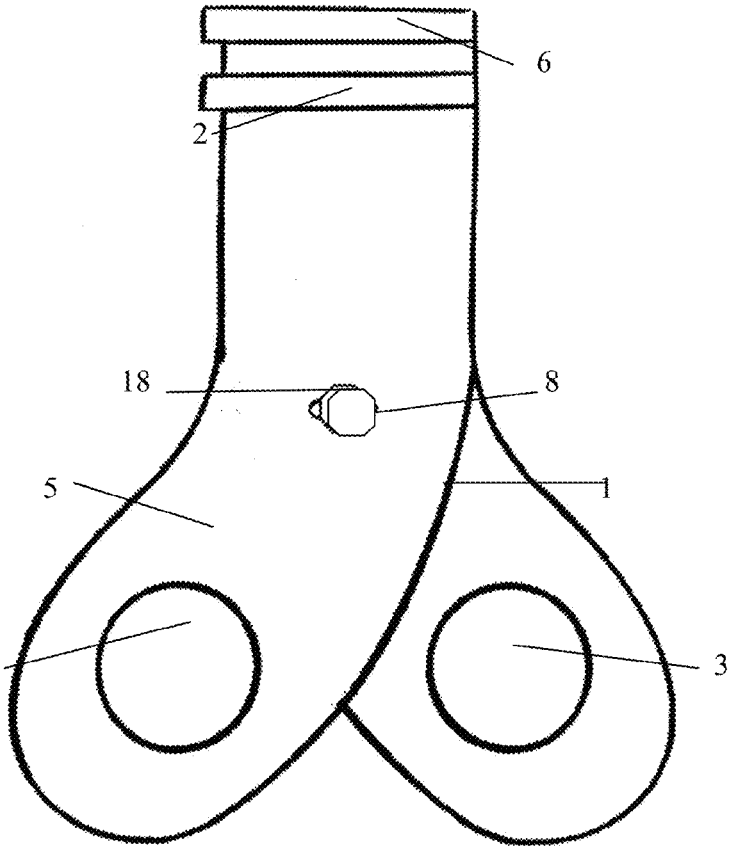
FIG. 11 is a back view of the golf training and teaching device showing how the left and the right components create the clip at the top thereof also showing a longer left and right component to increase vertical adjustment of the chin and head.

FIG. 11 shows the portable golf training and teaching device from the back with the clips 2 and 6 at the top and the slider hole 8 and nut 18. FIG. 11 also shows components 1 and 5 with the sighting holes 3 and 7. Also shown is the longer right side component 1 and left side component 5 to increase adjustability of the chin and head for additional vertical adjustment.

Figure 12:
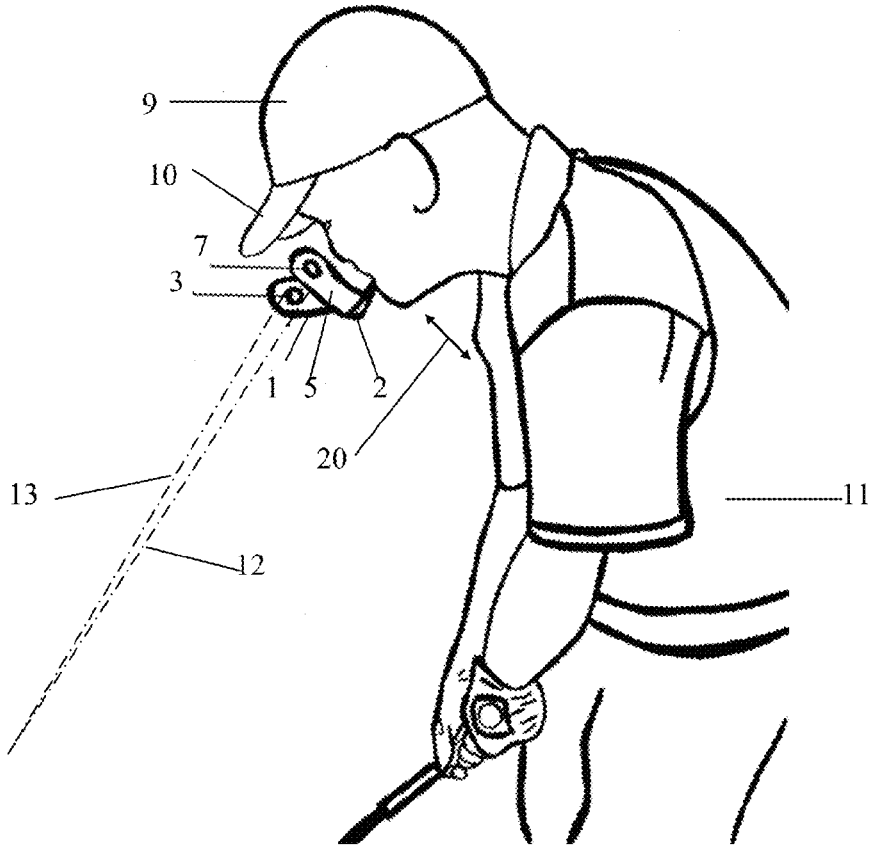
FIG. 12 is a perspective view of the golf training and teaching device being used by a golfer holding the device in his mouth.

FIG. 12 shows a perspective view of the golfer using the portable golf training and teaching device with the clips 2 and 6 being held in the golfer's mouth. The golfer has adjusted the sighting holes 3 and 7 for creating sight lines 12 and 13 to produce the stereo containment area 14. Also shown is the increased area between the golfer's chin and chest 20 which produces an unobstructed rotation of the shoulders in the back swing.

Figure 13:
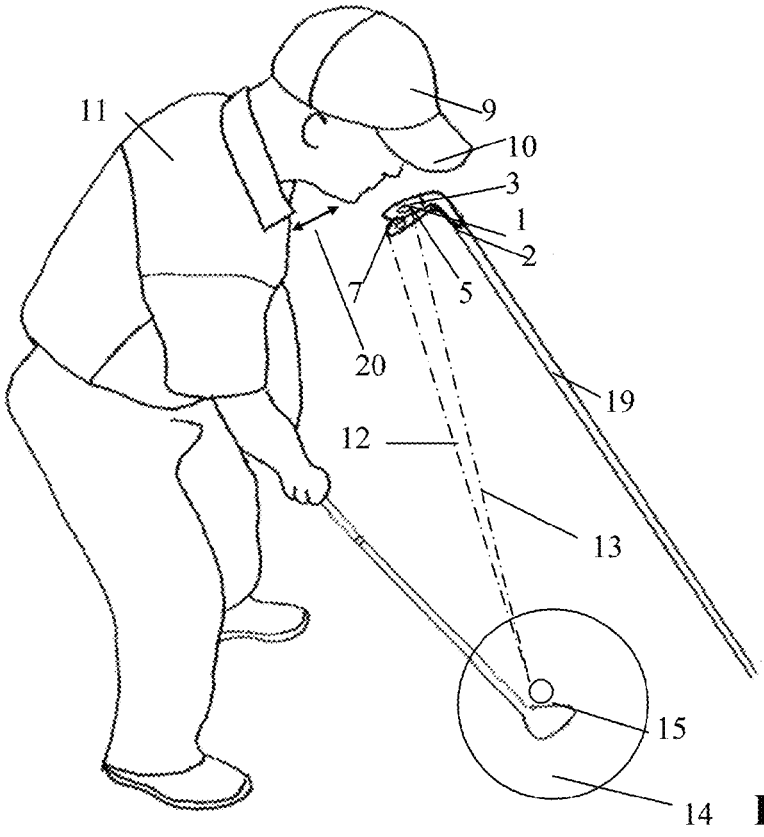
FIG. 13 is a perspective view of the golf training and teaching device being used by the golfer with the device attached to a pole secured to the ground.

FIG. 13 shows a perspective view of the golfer using the portable golf training and teaching device attached to a pole which is extending from the ground. The golfer is looking thru the sighting holes 3 and 7 that create sight lines 12 and 13 to produce the stereo view of the containment area 14 with the ball 15. Also shown is the increased area between the golfer's chin and chest 20 which produces an unobstructed and a maximum rotation of the shoulders in the back swing.

Figure 14:
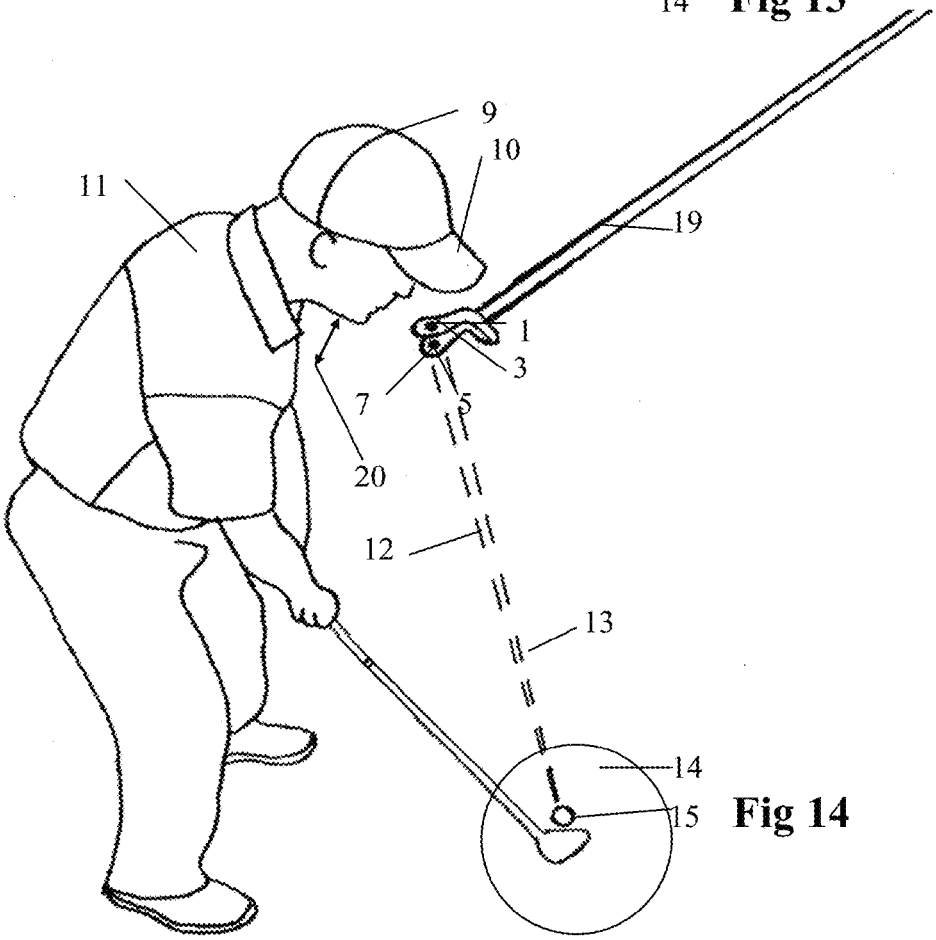
FIG. 14 is a perspective view of the golf training and teaching device being used by the golfer with the device attached to a pole to be mounted or secured to a frame or wall.

FIG. 14 is a perspective view of the golfer using the portable golf training and teaching device attached to a pole that is extending from a wall or frame. The golfer is looking through the sighting holes 3 and 7 that create sight lines 12 and 13 to produce the stereo view of the containment area 14 with the ball 15. Also shown is the increased area between golfer's chin and chest 20 which produces an unobstructed and a maximum rotation of the shoulders in the back swing.

Figure 15:
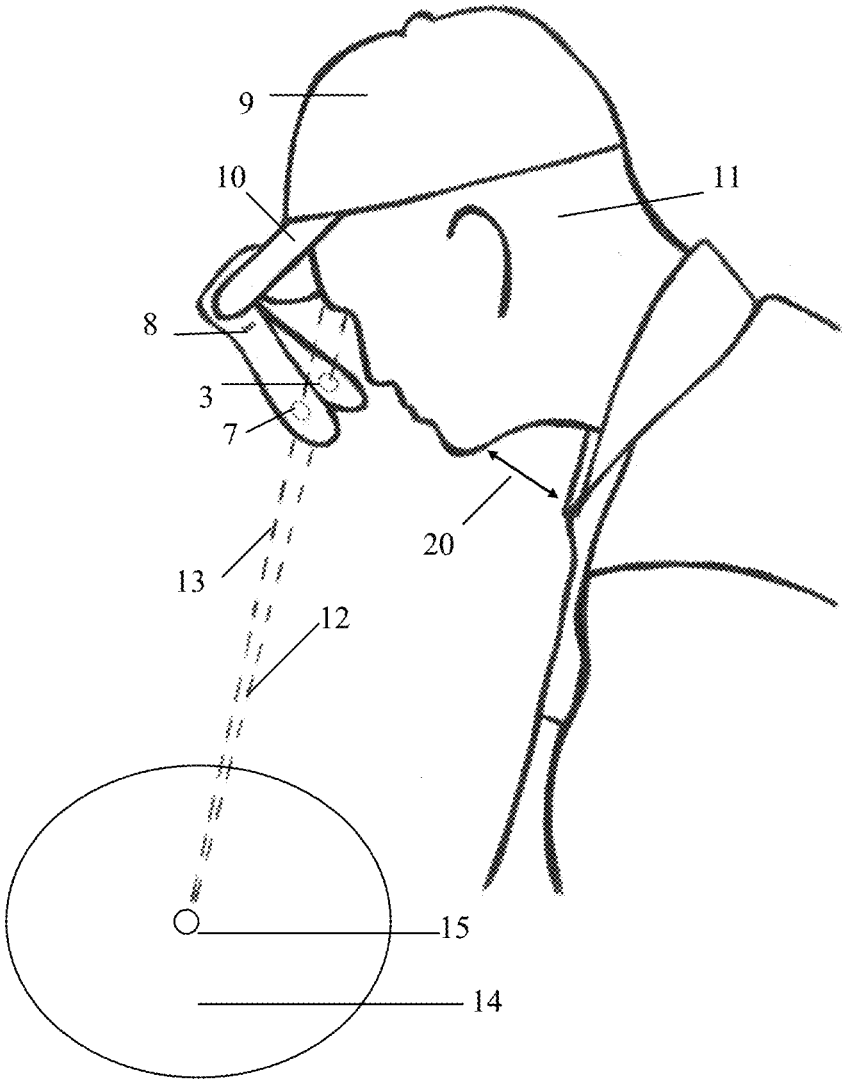
FIG. 15 is a perspective side view of the golf training and teaching device being used by a golfer as he is looking thru the left and right sighting holes which creates the stereo view of the containment area. The device is pulled down in front of golfer's face to create more space between his chin and chest to allow an unrestricted rotation of his shoulders under his chin.

FIG. 15 is a perspective view of the portable golf training and teaching device being used by the golfer showing the sighting holes 3 and 7 adjusted properly to create the sighting lines 12 and 13 to produce the stereo view of the containment area 14 with the ball 15. The portable golf training and teaching device has been adjusted in the set up position or address position to allow the golfer a more free rotation of the shoulders under the chin 20 in the back swing. To accomplish this, the brim of the hat 10 with the portable golf training and teaching device attached thereto has been pulled down slightly in front of the golfer's face which requires the golfer to raise the chin to see thru the sighing holes 3 and 7. This has created more space 20 between the chin and the chest to allow the shoulders to rotate unrestricted under the chin in the backswing.

The portable golf training and teaching device can be constructed, molded, or built into the hat and can be made from various materials, such as, but not limited to, acrylic, plastic, fiberglass, polycarbonate, steel, Styrofoam, cardboard, paper, wood, metals, nylon, glass or ceramic, cotton, and all the forms of hat manufacturing materials.

The portable golf training and teaching device can have the sighting holes 3 and 7 with various shapes and sizes including but not limited to round, square, diamond, rectangle, shamrock, crosses, shape of an eye, a heart or flowers, etc. The size of the sighting holes 3 and 7 can range from 1 mm to 75 nm. The construction of components 1 and 5 can vary in length and width and can be constructed into different shapes and designs.

The invention claimed is:

1. A golf training and teaching device for a golfer wearing a hat having a brim, and comprising:

a right-side L-shaped member comprising an upper leg and a lower leg depending from the upper leg, the lower leg having a sighting opening therein configured to be positioned adjacent the right eye of the golfer;

a left-side L-shaped member comprising an upper leg and a lower leg depending from the upper leg, the lower leg having a sighting opening therein configured to be positioned adjacent the left eye of the golfer;

the right-side and left-side L-shaped members being slidably coupled in partially overlapping relation so that the respective upper legs thereof overlay and define a clamp to be secured onto the brim of the hat; and the sighting openings of the right-side and left-side L-shaped members configured to provide a visual containment area for a golf ball positioned adjacent the golfer's feet.

2. The golf training and teaching device according to claim 1, wherein the lower legs of the right-side and left-side L-shaped members diverge outwardly from one another.

3. The golf training and teaching device according to claim 1, wherein the lower legs of the right-side and left-side L-shaped members each have slotted adjustment openings therein; and further comprising a fastener positioned through the slotted adjustment openings.

4. The golf training and teaching device according to claim 3, wherein the fastener comprises a screw and a nut.

5. The golf training and teaching device according to claim 1, wherein the lower leg of the right-side L-shaped member is longer than the leg of the left-side L-shaped member to define a gap between the upper legs.

6. The golf training and teaching device according to claim 1, wherein the sighting openings each have a circular shape.

7. The golf training and teaching device according to claim 6, wherein the circular shaped sighting openings have a diameter in a range of 1 to 75 mm.

8. The golf training and teaching device according to claim 1, wherein the sighting openings each have a rectangular shape.

9. The golf training and teaching device according to claim 1, wherein the right-side and left-side L-shaped members each comprises a transparent material.

* * * * *